US008288333B2

(12) United States Patent
Somerville Roberts

(10) Patent No.: US 8,288,333 B2
(45) Date of Patent: Oct. 16, 2012

(54) PROCESS FOR MAKING A DETERGENT COMPOSITION COMPRISING A HYDROPHILIC SILICA AND A COPOLYMER CONTAINING A CARBOXYLIC ACID MONOMER AND A SULFONIC ACID MONOMER

(75) Inventor: Nigel Patrick Somerville Roberts, Newcastle (GB)

(73) Assignee: The Procter & Gamble Company, Cincinnati, OH (US)

( * ) Notice: Subject to any disclaimer, the term of this patent is extended or adjusted under 35 U.S.C. 154(b) by 788 days.

(21) Appl. No.: 12/190,605

(22) Filed: Aug. 13, 2008

(65) Prior Publication Data

US 2009/0048134 A1 Feb. 19, 2009

(30) Foreign Application Priority Data

Aug. 16, 2007 (EP) ..... 07114431

(51) Int. Cl.
*C11D 3/37* (2006.01)
*C11D 3/08* (2006.01)

(52) U.S. Cl. ..... 510/476; 510/223; 510/224; 510/230; 510/232; 510/296; 510/297; 510/439; 510/466; 206/524.7; 206/528

(58) Field of Classification Search ..... 510/223, 510/224, 230, 232, 296, 297, 439, 466, 476; 206/524.7, 528
See application file for complete search history.

(56) References Cited

U.S. PATENT DOCUMENTS

| | | | |
|---|---|---|---|
| 3,929,678 | A | 12/1975 | Laughlin et al. |
| 4,000,093 | A | 12/1976 | Nicol et al. |
| 4,105,827 | A | 8/1978 | Brichard et al. |
| 4,228,042 | A | 10/1980 | Letton |
| 4,239,660 | A | 12/1980 | Kingry |
| 4,246,612 | A | 1/1981 | Berry et al. |
| 4,259,217 | A | 3/1981 | Murphy |
| 4,260,529 | A | 4/1981 | Letton |
| 4,681,592 | A | 7/1987 | Hardy et al. |
| 4,810,410 | A | 3/1989 | Diakun et al. |
| 4,820,439 | A | 4/1989 | Rieck |
| 4,966,723 | A | 10/1990 | Hodge et al. |
| 5,114,611 | A | 5/1992 | Van Kralingen et al. |
| 5,211,930 | A | 5/1993 | Schimmel et al. |
| 5,227,084 | A | 7/1993 | Martens et al. |
| 5,358,519 | A | 10/1994 | Grandjean et al. |
| 5,547,612 | A | 8/1996 | Austin et al. |
| 5,576,281 | A | 11/1996 | Bunch et al. |
| 5,766,371 | A | 6/1998 | Bunch et al. |
| 5,964,692 | A | 10/1999 | Blezard et al. |
| 2004/0116319 | A1 * | 6/2004 | Nitsch et al. ..... 510/475 |
| 2007/0145014 | A1 * | 6/2007 | Nishimoto et al. ..... 216/97 |
| 2008/0209863 | A1 | 9/2008 | Catlin et al. |

FOREIGN PATENT DOCUMENTS

| | | | |
|---|---|---|---|
| DE | 37 43739 | A1 | 6/1989 |
| EP | 0482807 | | 4/1992 |
| WO | WO 93/08876 | | 5/1993 |
| WO | 03/042347 | A1 | 5/2003 |
| WO | WO 03/042347 | * | 5/2003 |
| WO | WO 4013269 | A1 | 2/2004 |

OTHER PUBLICATIONS

Copy of PCT International Search Report Dated Jan. 14, 2009 —6 pgs.
U.S. Appl. No. 12/190,608, filed Aug. 13, 2008, Nigel Patrick Somerville Roberts.
The most current USPTO Office Action rejections/objections with mail date Aug. 20, 2009 from co-pending U.S. Appl. No. 12/190,608; 7 pgs.

* cited by examiner

*Primary Examiner* — Brian P Mruk
(74) *Attorney, Agent, or Firm* — Tiffany M. Zerby; Leonard W. Lewis; Steven W. Miller

(57) ABSTRACT

A process for making a detergent composition, the detergent composition comprising:

a) from about 0.1% to about 50% by weight of the composition of a polymer in particulate form comprising:
   i) a carboxylic acid monomer;
   ii) more than about 5% by weight of the polymer of a sulfonic acid monomer; and
   iii) optionally a non-ionic monomer; and
b) from about 0.01% to about 10% by weight of the composition of a hydrophilic silica.

the process comprising the steps of:

a) pre-mixing the polymer with the hydrophilic silica to obtain a polymer/silica premix; and
b) mixing polymer/silica premix with any additional detergent components.

7 Claims, No Drawings

PROCESS FOR MAKING A DETERGENT COMPOSITION COMPRISING A HYDROPHILIC SILICA AND A COPOLYMER CONTAINING A CARBOXYLIC ACID MONOMER AND A SULFONIC ACID MONOMER

TECHNICAL FIELD

The present invention is in the field of detergents, in particular it relates to a process for making a detergent composition comprising a carboxylated/sulfonated polymer. The invention also relates to a detergent composition obtainable according to the process. The composition is especially suitable for use in automatic dishwashing.

BACKGROUND OF THE INVENTION

The use of carboxylated/sulfonated polymers in automatic dishwashing is known (DE 102 33 834, U.S. Pat. No. 5,547,612). These polymers help with the cleaning and at the same time provide anti-filming and anti-spotting benefits, in particular on glassware. An example of the use of this kind of polymers, in liquid form, in automatic dishwashing can be found in EP 1,404,790 B1, which relates to a liquid aqueous machine dishwashing product comprising a carboxylated/sulfonated polymer.

US 2004/0116319 discusses problems associated with carboxylated/sulfonated polymers in liquid form. The polymers in liquid form can only be processed with great difficulty, since the corresponding solutions are considerably tacky and impair the formation of homogeneous, flowable mixtures. In addition, particulate products into which the polymer has been incorporated from a liquid delivery form have a tendency to clump, thus lowering consumer acceptance, while tableted products have problems such as after-curing and poor dissolution properties.

'319 addresses the problem of providing a solid machine dishwashing agent that comprises carboxylated/sulfonated polymers without giving rise to product problems such as clumping, after-curing or poor dissolution properties. The problem is allegedly solved by the use of the carboxylated/sulfonated polymers in particulate form wherein at least 50% by weight of the polymer have a particle size greater than 200 μm. Carboxylated/sulfonated polymers are physically instable, particularly, under manufacturing plant conditions. The polymers, even when they have the particle size proposed in '319, can form a non-flowable glue-like material that it is very difficult to process. Thus, one of the objectives of the present invention is to overcome the in-plant processability and storage issues associated to carboxylated/sulfonated polymers. '319 concerns the stability of carboxylated/sulfonted polymers in a detergent product. The present invention concerns the stability of carboxylated/sulfonted polymers when they are stored in bulk and they are used as raw material in a detergent making process.

SUMMARY OF THE INVENTION

According to a first aspect of the present invention, there is provided a process for making a detergent composition, preferably an automatic dishwashing detergent composition. The detergent composition comprises a carboxylated/sulfonated polymer in particulate form. Carboxylated/sulfonated polymers are used in automatic dishwashing compositions to improve cleaning and to provide anti-filming and anti-spotting benefits, in particular on glass, plastic and metal substrates. This type of polymers has been found to have poor physical stability and as consequence they are difficult to store, handle and process. The polymer easily looses its free-flowing properties and become a glue-like material. The stability of the polymer is negatively impacted by the high temperature and humidity conditions found in manufacturing plants.

It has now been found that the addition of hydrophilic silica to the polymer helps the polymer to maintain its free-flowing properties making it easier to handle and process it. Thus, according to the process of the invention a carboxylated/sulfonated polymer is mixed with hydrophilic silica to form a premix that can be subsequently admixed with the rest of the detergent components. Surprisingly, the silica in the final product does not deposit either on the dishwasher or on the washed items during the dishwashing operation. One of the problems found in dishwashing is that insoluble materials can create residues on the dishwasher or on the washed items. For this reason, process aids that can be used in laundry detergents are not usually suitable for automatic dishwashing detergents.

A simple method to determine whether a silica is "hydrophilic" is by stirring it into water. For example, 0.5 g of silica are added to a beaker containing 200 ml of pure water, at a temperature of about 20° C., the mixture is vigorously agitated (about 100 rpm, using a 3 cm diameter impeller). It can be said that the silica is "hydrophilic" if the silica disperses in the water, i.e., the silica is not floating on the surface, this can be evaluated with the naked eye.

According to a second aspect of the present invention, there is provided a detergent composition, preferably an automatic dishwashing detergent composition, obtainable, preferably obtained, according to the process of the invention. The detergent composition of the invention comprises:

a) from about 0.1% to about 50%, preferably from 1% to about 20%, more preferably from 2% to 10% by weight of the composition of a polymer in particulate form comprising:

i) a carboxylic acid monomer;

ii) more than about 5%, preferably from about 10 to about 60%, more preferably from about 15 to about 35% by weight of the polymer of one or more sulfonic acid monomer; and iii) optionally a non-ionic monomer; and b) from about 0.001% to about 10%, preferably from 0.01% to about 5% by weight of the composition of a hydrophilic silica.

In preferred embodiments, the polymer has a weight geometric mean particle size of from about 400 μm to about 1200 μm, more preferably from about 500 μm to about 1000 μm and especially from about 700 μm to about 900 μm. Preferably the polymer has low level of fines and coarse particles, in particular less than 10% by weight of the polymer are above about 1400, more preferably about 1200 or below about 400, more preferably about 200 μm. These mean particle size and particle size distribution further contribute to the stability of the polymer/silica premix. In especially preferred embodiments, from the stability point of view, the polymer has a weight geometric mean particle size of from about 700 to about 1000 μm with less than about 3% by weight of the polymer above about 1180 μm and less than about 5% by weight of the polymer below about 200 μm. The weight geometric mean particle size can be measured using a Malvern particle size analyser based on laser diffraction.

In another embodiment, more than 50% by weight of the polymer has a particle size below about 200 μm, preferably below about 180 μm. This can be determined by sieving the polymer particles. Surprisingly, even such small particles are flowable in combination with the silica.

The polymer should be kept protected from humidity, for example in a sealed container, in order to avoid clumping before the particle size is measured.

In preferred embodiments the silica has a weight geometric mean particle size of from about 1 to about 100 μm, more preferably from about 2 to about 50 μm. The silica particle size can for example be measured according to ASTM c 690-1992. This particle size also contributes towards the stability of the polymer/silica premix.

Additional benefits are achieved when the polymer has a relatively large weight geometric mean particle size and narrow particle size distribution and the silica has a small mean particle size. Particularly good combinations are those in which the polymer has a weight geometric mean particle size of from about 700 to about 1000 μm with less than about 3% by weight of the polymer above about 1180 μm and less than about 5% by weight of the polymer below about 200 μm and the silica has a weight geometric mean particle size of from about 10 to about 40 μm. This is favourable not only from the stability point of view but it also allows to minimise the amount of silica needed.

In preferred embodiments the polymer and the silica are mixed in a weight ratio of from about 90:1 to about 10:1, more preferably from about 60:1 to about 30:1. It is surprising that such small amount of silica had such an impact on the stability of the polymer.

In a preferred embodiment the detergent composition is in the form of a water-soluble pouch, preferably, a multi-compartment pouch. Multi-compartment pouches provide great flexibility for chemistry separation. Different chemistries can be located into different compartments, permitting the separation of incompatibles ingredients or ingredients in different physical forms, for example separation of liquids and solid ingredients.

In a preferred embodiment the detergent composition is in the form of a multi-compartment pouch containing the polymer and silica in a powder containing compartment of the pouch. Preferably, the pouch also has a liquid compartment comprising a liquid surfactant composition capable of providing grease cleaning and finishing benefits.

DETAILED DESCRIPTION OF THE INVENTION

The present invention envisages a process for making a detergent composition comprising a carboxylated/sulfonated polymer in particulate form and a composition comprising the polymer. The process of the invention overcomes the physical stability issues associated to the polymer during manufacture of the detergent composition. The invention also provides processes and compositions in which the polymer and hydrophilic silica have very specific particle sizes. These embodiments are preferred from a stability viewpoint and minimisation of the amount of silica used.

The detergent composition of the invention is in solid form, it could for example be in the form of loose powder, tablet o power-containing pouch, including multi-compartment pouches wherein at least one of the compartments contains the polymer.

Sulfonated/Carboxylated Polymer

The sulfonated/carboxylated polymer suitable for the process and composition of the invention is used in any suitable amount from about 0.1% to about 50%, preferably from 1% to about 20%, more preferably from 2% to 10% by weight of the composition.

Suitable sulfonated/carboxylated polymers described herein may have a weight average molecular weight of less than or equal to about 100,000 Da, or less than or equal to about 75,000 Da, or less than or equal to about 50,000 Da, or from about 3,000 Da to about 50,000, preferably from about 5,000 Da to about 45,000 Da.

As noted herein, the sulfonated/carboxylated polymers may comprise (a) at least one structural unit derived from at least one carboxylic acid monomer having the general formula (I):

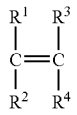

(I)

wherein $R^1$ to $R^4$ are independently hydrogen, methyl, carboxylic acid group or $CH_2COOH$ and wherein the carboxylic acid groups can be neutralized; (b) optionally, one or more structural units derived from at least one nonionic monomer having the general formula (II):

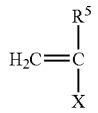

(II)

wherein $R^5$ is hydrogen, $C_1$ to $C_6$ alkyl, or $C_1$ to $C_6$ hydroxyalkyl, and X is either aromatic (with $R^5$ being hydrogen or methyl when X is aromatic) or X is of the general formula (III):

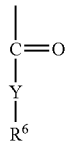

(III)

wherein $R^6$ is (independently of $R^5$) hydrogen, $C_1$ to $C_6$ alkyl, or $C_1$ to $C_6$ hydroxyalkyl, and Y is O or N; and at least one structural unit derived from at least one sulfonic acid monomer having the general formula (IV):

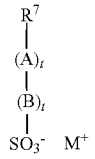

(IV)

wherein $R^7$ is a group comprising at least one $sp^2$ bond, A is O, N, P, S or an amido or ester linkage, B is a mono- or polycyclic aromatic group or an aliphatic group, each t is independently 0 or 1, and $M^+$ is a cation. In one aspect, $R^7$ is a $C_2$ to $C_6$ alkene. In another aspect, $R^7$ is ethane, butene or propene.

Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth) allyl sulfonate, vinyl sulfonate, sodium phenyl (meth) allyl ether sulfonate, or 2-acrylamido-methyl propane sulfonic acid. Preferred non-ionic monomers include one or more of the following: methyl (meth) acrylate, ethyl (meth) acrylate, t-butyl (meth) acrylate, methyl (meth) acrylamide, ethyl (meth) acrylamide, t-butyl (meth) acrylamide, styrene, or α-methyl styrene.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

The carboxylic acid is preferably (meth)acrylic acid. The sulfonic acid monomer is preferably one of the following: 2-acrylamido methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, allyloxybenzenesulfonic acid, methallyloxybenzensulfonic acid, 2-hydroxy-3-(2-propenyloxy)propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethylacrylamid, sulfomethylmethacrylamide, and water soluble salts thereof. The unsaturated sulfonic acid monomer is most preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Hydrophilic Silica

The compositions of the invention also comprise from about 0.001 to 10%, preferably from about 0.05 to 5%, more preferably from about 0.1 to 2%, and especially from about 0.3 to 1% by weight of the composition, of hydrophilic silica. Such materials are extremely fine-particle size silicon dioxides. Amorphous synthetic silica can be manufactured using a thermal or pyrogenic or a wet process. The thermal process leads to fumed silica, the wet process to either precipitated silica o silica gels. Individual particles have a diameter typically ranging from about 0.01 μm to about 100 μm, preferably about 10 μm to about 40 μm and a weight geometric mean particle size (as measured using a Multisizer 100 μm following ASTM C 690-1992) of from about 0.1 μm to about 40 μm, preferably from about 1 μm to 20 μm.

Hydrophilic silica materials useful herein are commercially available from Degussa Corporation under the tradename of Sipernat®, in particular Sipernat® 22 S.

Process

The process of the invention is generally initiated by introducing the carboxylated/sulfonated polymer, in particulate form, into a mixing chamber, preferably provided with stirring means, and adding the silica. It is sufficient to mix the polymer with the silica without having very stringent mixing requirements. Total coverage or coating of the polymer is not required, thus the processability benefits are obtained by means of a very simple mixing step, without requiring special equipment or expensive operation costs. The mixing can take place, for example, in a low shear mixer or rotating drum. The hydrophilic silica can then be added to the drum or mixer while it is in motion. The hydrophilic silica deposits on the surface of the polymer and makes it free flowing. The invention can be practised as a batch or a continuous process.

The mixing is preferably carried out at room temperature, i.e., about 25° C.,

Once the polymer/silica premix is formed it can be admixed with the rest of the powder components.

In a preferred embodiment of the present invention the detergent composition is in the form of a multi-phase unit dose product, preferably an injection-moulded, vacuum- or thermoformed multi-compartment water-soluble pouch, wherein at least one of the phases comprises the polymer/silica mix. Preferred manufacturing methods for unit dose executions are described in WO 02/42408. Any water-soluble film-forming polymer which is compatible with the compositions of the invention and which allows the delivery of the composition into the main-wash cycle of a dishwasher or laundry washing machine can be used as enveloping material.

Most preferred pouch materials are PVA films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

Single compartment pouches containing the carboxylated/sulfonated polymer can be made by placing a first piece of film in a mould, drawing the film by vacuum means to form a pocket, filling the formed pocket with a powder composition comprising the polymer/silica mix and closing and sealing the formed pocket with another piece of film.

Multi-compartment pouches containing the carboxylated/sulfonated polymer can be made by placing a first piece of film in a mould, drawing the film by vacuum means to form a pocket, pinpricking the film, dosing and tamping a powder composition, placing a second piece of film over the first pocket to form a new pocket, filling the new pocket with a second composition, for example a liquid composition, placing a piece of film over this second filled pocket and sealing the three films together to form the dual compartment pouch. Alternatively, the pouch and in particular one of the components (the first formed compartment) can be made by injection moulding.

In preferred embodiments the detergent composition comprises a non-ionic surfactant, preferably in a level of from about 0.1 to about 10%, more preferably form about 0.5 to about 3% by weight of the composition. Usually the non-ionic surfactant is sprayed onto the powder composition, prior or posterior to the addition of the polymer/silica premix. Preferred herein are multi-compartment pouches having a compartment containing a solid composition optionally comprising from about 0.5 to about 3% by weight of the composition of non-ionic surfactant and a compartment containing a liquid composition optionally comprising from about 5 to about 90%, more preferably from about 20 to about 80% and especially from about 30 to about 70% by weight of the composition of non-ionic surfactant.

Detergent Composition

The compositions herein can be built or un-built, generally built and comprise one or more detergent active components which may be selected from bleaching agents, surfactants, alkalinity sources, enzymes, thickeners (in the case of liquid, paste, cream or gel compositions), anti-corrosion agents (e.g. sodium silicate) and disrupting and binding agents (in the case of powder, granules or tablets). Highly preferred detergent components include a builder compound, an alkalinity source, a surfactant, an enzyme and a bleaching agent.

Surfactant

A surfactant suitable for use herein is preferably low foaming by itself or in combination with other components (i.e. suds suppressers). Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$-$C_{20}$, preferably $C_{10}$-$C_{18}$ linear or branched; cationic surfactants such as chlorine esters (U.S. Pat. No. 4,228,042, U.S. Pat. No. 4,239,660 and U.S. Pat. No. 4,260,529) and mono $C_6$-$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$-$C_{18}$ primary alcohols), ethoxylated-propoxylated alcohols (e.g., BASF Poly-Tergent® SLF18), epoxy-capped poly (oxyalkylated) alcohols (e.g., BASF Poly-Tergent® SLF18B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$-$C_{20}$ alkyl amine oxides (preferred amine oxides for use herein include $C_{12}$ lauryldimethyl amine oxide, $C_{14}$ and $C_{16}$hexadecyl dimethyl amine oxide), and alkyl amphocarboxylic surfactants such as Miranol™ C2M; and zwitterionic surfactants such as the betaines and sultaines; and mixtures thereof. Surfactants suitable herein are disclosed, for example, in U.S. Pat. No. 3,929,678, U.S. Pat. No. 4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of composition. Preferred surfactant for use herein are low foaming and include low cloud point nonionic surfactants and mixtures of higher foaming surfactants with low cloud point nonionic surfactants which act as suds suppresser therefor.

Builder

Builders suitable for use herein include water-soluble builders such as citrates, carbonates and polyphosphates e.g. sodium tripolyphosphate and sodium tripolyphosphate hexahydrate, potassium tripolyphosphate and mixed sodium and potassium tripolyphosphate salts; and partially water-soluble or insoluble builders such as crystalline layered silicates (EP-A-0164514 and EP-A-0293640) and aluminosilicates inclusive of Zeolites A, B, P, X, HS and MAP. The builder is typically present at a level of from about 1% to about 80% by weight, preferably from about 10% to about 70% by weight, most preferably from about 20% to about 60% by weight of composition.

Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Enzyme

Enzymes suitable herein include bacterial and fungal cellulases such as Carezyme and Celluzyme (Novo Nordisk A/S); peroxidases; lipases such as Amano-P (Amano Pharmaceutical Co.), M1 Lipase® and Lipomax® (Gist-Brocades) and Lipolase® and Lipolase Ultra® (Novo); cutinases; proteases such as Esperase®, Alcalase®, Durazym® and Savinase® (Novo) and Maxatase®, Maxacal®, Properase® and Maxapem® (Gist-Brocades); α and β amylases such as Purafect Ox Am® (Genencor) and Termamyl®, Ban®, Fungamyl®, Duramyl®, and Natalase® (Novo); pectinases; and mixtures thereof. Enzymes are preferably added herein as prills, granulates, or cogranulates at levels typically in the range from about 0.0001% to about 2% pure enzyme by weight of composition.

Bleaching Agent

Bleaching agents suitable herein include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410).

Low Cloud Point Non-Ionic Surfactants and Suds Suppressers

The suds suppressers suitable for use herein include nonionic surfactants having a low cloud point. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360-362). As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., BASF Poly-Tergent® SLF18) and epoxy-capped poly(oxyalkylated) alcohols (e.g., BASF Poly-Tergent® SLF18B series of nonionics, as described, for example, in U.S. Pat. No. 5,576,281).

Preferred low cloud point surfactants are the ether-capped poly(oxyalkylated) suds suppresser having the formula:

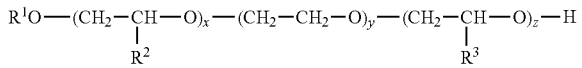

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

Other suitable components herein include organic polymers having dispersant, anti-redeposition, soil release or other detergency properties invention in levels of from about 0.1% to about 30%, preferably from about 0.5% to about 15%, most preferably from about 1% to about 10% by weight of composition. Preferred anti-redeposition polymers herein include acrylic acid containing polymers such as Sokalan PA30, PA20, PA15, PA10 and Sokalan CP10 (BASF GmbH), Acusol 45N, 480N, 460N (Rohm and Haas), acrylic acid/maleic acid polymers such as Sokalan CP5 and acrylic/methacrylic polymers. Preferred soil release polymers herein include alkyl and hydroxyalkyl celluloses (U.S. Pat. No. 4,000,093), polyoxyethylenes, polyoxypropylenes and polymers thereof, and nonionic and anionic polymers based on terephthalate esters of ethylene glycol, propylene glycol and mixtures thereof.

Heavy metal sequestrants and crystal growth inhibitors are suitable for use herein in levels generally from about 0.005% to about 20%, preferably from about 0.1% to about 10%, more preferably from about 0.25% to about 7.5% and most preferably from about 0.5% to about 5% by weight of composition, for example diethylenetriamine penta (methylene phosphonate), ethylenediamine tetra(methylene phosphonate) hexamethylenediamine tetra(methylene phosphonate), ethylene diphosphonate, hydroxy-ethylene-1,1-diphosphonate, nitrilotriacetate, ethylenediaminotetracetate, ethylenediamine-N,N'-disuccinate in their salt and free acid forms.

The compositions herein can contain a corrosion inhibitor such as organic silver coating agents in levels of from about 0.05% to about 10%, preferably from about 0.1% to about 5% by weight of composition (especially paraffins such as Winog 70 sold by Wintershall, Salzbergen, Germany), nitrogen-containing corrosion inhibitor compounds (for example benzotriazole and benzimadazole—see GB-A-1137741) and Mn(II) compounds, particularly Mn(II) salts of organic ligands in levels of from about 0.005% to about 5%, preferably from about 0.01% to about 1%, more preferably from about 0.02% to about 0.4% by weight of the composition.

In terms of pouch configuration, in a preferred embodiment the pouch is a multi-compartment pouch, preferably a dual-compartment pouch, comprising a first compartment containing a composition in solid form and a second compartment containing a composition in liquid form. Preferably the solid: liquid compositions are in a weight ratio of from about 1:50 to about 50:1, preferably from about 2:1 to about 30:1. Preferably the total weight of the pouch is from about 10 to about 30 grams, more preferably from about 15 to about 22 grams. Preferably the solid compartment contains the carboxylated/sulfonated polymer. The solid compartment might additionally contain small amount of non-ionic surfactant (from about 0.001 to about 2% by weight of the solid composition). The liquid compartment optionally comprises a liquid surfactant and preferably a perfume.

In a preferred configuration, the pouch has two, or more compartments arranged in a superposed manner, preferably the solid and liquid compartments have similar footprints. This execution is particularly suitable for the case of liquid compartments superposed over solid compartments. The liquid compartment can protect the solid compartment from moisture pick up from the surrounding environment.

The water pick up can be minimised by placing the liquid compartment on top of the solid compartment. Moisture pick up can also be reduced by having a moisture transfer barrier on the enveloping material. Preferably, the moisture transfer barrier comprises a material which reduces the permeability of the enveloping material. The material provides protection during storage but releases the protected ingredients during the cleaning process.

EXAMPLES

Abbreviations Used in Examples

In the examples, the abbreviated component identifications have the following meanings:

| | |
|---|---|
| Carbonate | Anhydrous sodium carbonate |
| STPP | Sodium tripolyphosphate |
| Silicate | Amorphous Sodium Silicate ($SiO_2$:$Na_2O$ = from 2:1 to 4:1) |

-continued

| | |
|---|---|
| Percarbonate | Sodium percarbonate of the nominal formula $2Na_2CO_3 \cdot 3H_2O_2$ |
| Termamyl | α-amylase available from Novo Nordisk A/S |
| FN3 | protease available from Genencor |
| SLF18 | Poly-Tergent ® available from BASF |
| ACNI | alkyl capped non-ionic surfactant of formula $C_{9/11}$ $H_{19/23}$ $EO_8$-cyclohexyl acetal |
| $C_{14}AO$ | tetradecyl dimethyl amine oxide |
| $C_{16}AO$ | hexadecyl dimethyl amine oxide |
| Duramyl | α-amylase available from Novo Nordisk A/S |
| Acusol 588G | Carboxylated/sulfonated polymer available from Rohm and Haas |
| Sipernat D22S | Hydrophilic silica available from Degussa |
| DPG | dipropylene glycol |

In the following examples all levels are quoted as per cent (%) by weight.

Examples 1 to 4

Acusol 588G and Sipernat D22S are mixed in a weight ratio of 46:1. The premix has excellent flow and handling properties. The premix is admixed with the rest of the ingredients in particulate form. The surfactant is sprayed onto the resulting mixture.

The compositions of examples 1 to 4 are introduced in a two compartment layered PVA rectangular base pouch. The dual compartment pouch is made from a Monosol M8630 film as supplied by Chris-Craft Industrial Products. 17.2 g of the particulate composition and 4 g of the liquid composition are placed in the two different compartments of the pouch. The pouch dimensions under 2 Kg load are: length 3.7 cm, width 3.4 cm and height 1.5 cm. The longitudinal/transverse aspect ratio is thus 1.5:3.2 or 1:2.47. The pouch is manufactured using a two-endless surface process, both surfaces moving in continuous horizontal as described in WO 02/42408. According to this process a first web of pouches is prepared by forming and filling a first moving web of open pouches mounted on the first endless surface and closing the first web of open pouches with the second web of filled and sealed pouches moving in synchronism therewith.

| | Example | | | |
|---|---|---|---|---|
| | 1 | 2 | 3 | 4 |
| Particulate composition | | | | |
| STPP | 56 | 56 | 57 | 57 |
| HEDP | 1 | 1 | 1 | 1 |
| Termamyl | 1.5 | 1.5 | | |
| FN3 | 2 | 2 | | |
| Percarbonate | 17 | 17 | 17.5 | 17.5 |
| Carbonate | 11 | 11 | 12 | 12 |
| Silicate | 7 | 7 | 8 | 8 |
| Acusol 588G | 3.92 | 3.92 | 3.92 | 3.92 |
| Sipernat D22S | 0.08 | 0.08 | 0.08 | 0.08 |
| Perfume | 0.5 | 0.5 | 0.5 | 0.5 |
| Liquid composition | | | | |
| DPG | 59.5 | 59.5 | 55 | 55 |
| FN3 Liquid | | | 2.6 | 2.4 |
| Duramyl Liquid | | | 2.0 | 2.4 |
| $C_{14}$ AO | 20 | | 20 | |
| $C_{16}$ AO | | 20 | | 20 |
| ACNI | | 20 | | 20 |
| SLF18 | 20 | | 20 | |
| Dye | 0.5 | 0.5 | 0.4 | 0.2 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A process for making a detergent composition, the detergent composition comprising:

a) from about 0.1% to about 50% by weight of the composition of a polymer in particulate form comprising:
   i) a carboxylic acid monomer;
   ii) more than about 5% by weight of the polymer of one or more sulfonic acid monomer; and
   iii) optionally a non-ionic monomer; and b) from about 0.01% to about 10% by weight of the composition of a hydrophilic silica, the process comprising the steps of mixing the polymer with the hydrophilic silica to obtain a polymer/silica premix and mixing the polymer/silica premix with any additional detergent components.

2. A process according to claim 1 wherein the polymer has a weight geometric mean particle size of from about 400 μm to about 1200 μm.

3. A process according to claim 1 wherein the polymer has a weight geometric mean particle size of from about 700 μm to about 1000 μm with less than about 3% by weight of the polymer above about 1180 μm and less than about 5% by weight of the polymer below about 200 μm.

4. A process according to claim 1 wherein more than 50% by weight of the polymer has a particle size below about 200 μm.

5. A process according to claim 1 wherein the silica has a weight geometric mean particle size from about 1 to about 40 μm.

6. A process according to claim 1 wherein the polymer and the silica are in a weight ratio of from about 60:1 to about 30:1.

7. A process according to claim 1 wherein the detergent composition further comprises from about 0.1 to about 10% by weight of the composition of a non-ionic surfactant.

* * * * *